US006392344B1

(12) United States Patent
Hong

(10) Patent No.: US 6,392,344 B1
(45) Date of Patent: May 21, 2002

(54) PLASMA DISPLAY DEVICE

(75) Inventor: Byoung-hee Hong, Cheonan (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 09/524,765

(22) Filed: Mar. 13, 2000

(30) Foreign Application Priority Data

Apr. 16, 1999 (KR) ..... 99-13495

(51) Int. Cl.[7] ..... H01J 17/49
(52) U.S. Cl. ..... 313/586; 313/582; 313/584
(58) Field of Search ..... 313/586, 582, 313/583, 584, 585, 587, 479

(56) References Cited

U.S. PATENT DOCUMENTS 5,565,742 A * 10/1996 Shichao et al. ..... 315/366
5,661,500 A 8/1997 Shinoda et al.
5,736,815 A 4/1998 Amemiya
5,990,617 A * 11/1999 Kanae et al. ..... 313/582
6,157,354 A 12/2000 Amemiya
6,288,488 B1 * 9/2001 Amemiya ..... 313/582

* cited by examiner

*Primary Examiner*—Vip Patel
*Assistant Examiner*—Ken A Berck
(74) *Attorney, Agent, or Firm*—Leydig, Voit & Mayer, Ltd.

(57) ABSTRACT

A plasma display device includes a front substrate, first and second electrodes in parallel on an inner surface of the front substrate, a first dielectric layer on the inner surface of the front substrate covering the first electrode, a rear substrate facing the front substrate, a third electrode on an inner surface of the rear substrate crossing the first and second electrodes perpendicularly, a second dielectric layer on the inner surface of the rear substrate covering the third electrode, partitions forming discharge spaces opposite the dielectric layer of the rear substrate, and a phosphor coating side surfaces of respective partitions and producing red, green, or blue light. In the plasma display device, the width of the first or second electrodes at the discharge space coated with the phosphor emitting blue light, extending toward a region where light is not emitted, is larger than the widths of each of the first and second electrodes at discharge spaces coated with the phosphors producing red and green light. Thus, white balance can be easily represented and the brightness of the device is improved.

5 Claims, 5 Drawing Sheets

PLASMA DISPLAY DEVICE

BACKGROUND OF THE INVENTION

1. Field of the Invention

The present invention relates to a plasma display device, and more particularly, to a plasma display device in which the brightness of a blue pixel is improved.

2. Description of the Related Art

In general, a plasma display device for displaying an image utilizing a gas discharge is widely known as a display device that may replace the CRT (cathode ray tube) due to its superior display capabilities such as display size, brightness, contrast, afterimage, and viewing angle. In the plasma display device, an DC or AC voltage is applied to electrodes, and a gas discharge occurs between the electrodes. Then, ultraviolet rays are emitted to excite phosphors and emit light.

FIG. 1 is an exploded perspective view showing the structure of a common AC type plasma display device. Referring to the drawing, a first electrode 13X, which is a common electrode, and a second electrode 13Y, which is a scan electrode, are provided in pairs on an inner surface of a front glass substrate 11. A third electrode 13A, which is an address electrode is located on an inner surface of a rear glass substrate 12. The first electrode 13X and the second electrode 13Y, and the third electrode 13A are strips on the inner surface of the front glass substrate 11 and the rear glass substrate 12, respectively, such that they cross perpendicularly when the two substrates 11 and 12 are assembled. A dielectric layer 14 and a protective layer 15 are sequentially deposited on an inner surface of the front glass substrate 11. A plurality of partitions 17 on the upper surface of a dielectric layer 14' forming a cell 19 between neighboring partitions 17. The cell 19 is filled with inert gas such as argon (Ar). Also, a side surface of the cell 19 is coated with a phosphor 18. Respective cells 19 correspond to pixels producing red (R), green (G) or blue (B) light and are respectively and is coated with phosphors producing corresponding to each color. A bus electrode (not shown) can be provided to enhance the function of the first electrode 13*a* in another example.

In the operation of the plasma display device having the above structure, a high voltage, that is, a trigger voltage, is applied to cause a discharge between the first electrode 13X and the third electrode 13A. As cations are accumulated in the dielectric layer 14 by the trigger voltage, a discharge occurs. When the trigger voltage exceeds a threshold voltage, argon gas in the cell 19 changes to a plasma so that a discharge between the neighboring first and second electrodes 13X and 13Y can be stably maintained. In the stable discharge ultraviolet rays in the discharge collide with the phosphor 18 which emits light. Thus, each pixel formed by the cell 19 can display an image.

In the above display device, the structure of all pixels is identical and thus the sustaining discharge condition for each cell is the same. As the discharge condition is the same, the brightness of each pixel is proportional to the efficiency of light emission of the phosphor. Actually, the efficiency of light emission of a blue phosphor is the lowest. Thus, when red, green and blue phosphors are excited to emit light under the same conditions, the brightness of the blue pixel is the lowest. Consequently, a white balance white by mixing red, green, and blue colors together cannot be achieved.

According to the conventional technology, to represent white balance, the brightness of red and green cells are lowered to correspond to the level of the brightness of the blue cell by using circuitry decreasing the number of discharge sustaining pulses. However, this method only manages the balance by an overall reduction in the brightness. Therefore, it is a disadvantage in the conventional technology that the overall brightness is lowered.

SUMMARY OF THE INVENTION

To solve the above problem, it is an objective of the present invention to provide a plasma display device having improved brightness.

It is another objective of the present invention to provide a plasma display device in which the brightness of a blue pixel is improved.

Accordingly, to achieve the above objective, there is provided a plasma display device which comprises a front substrate, first and second electrodes formed in parallel on an inner surface of the front substrate, a first dielectric layer formed on the inner surface of the front substrate to cover the first electrode, a rear substrate disposed to face the front substrate, a third electrode formed on an inner surface of the rear substrate to cross the first and second electrodes perpendicularly, a second dielectric layer formed on the inner surface of the rear substrate to cover the third electrode, a partition forming a discharge space above the dielectric layer of the rear substrate, and a phosphor coated on a side surface of the partition corresponding to red, green or blue. In the plasma display device, the width of the first or second electrode at the position corresponding to a discharge space coated with the blue phosphor, extending toward a region where light is not emitted, is formed to be greater than that of each of the first and second electrodes at the position corresponding to a discharge space coated with the red or green phosphor.

It is preferred in the present invention that the distance between the first electrode and the second electrode at the position corresponding to a discharge space coated with the blue phosphor is formed to be narrower than that of the first electrode and the second electrode at the position corresponding to a discharge space coated with the red or green phosphor.

Also, it is preferred in the present invention that the first dielectric layer of the front substrate at the position corresponding to a discharge space coated with the blue phosphor is formed to be thinner than the area of the first dielectric layer corresponding to a discharge space coated with the red or green phosphor.

BRIEF DESCRIPTION OF THE DRAWINGS

The above objectives and advantages of the present invention will become more apparent by describing in detail a preferred embodiment thereof with reference to the attached drawings in which.

DETAILED DESCRIPTION OF THE INVENTION

Figure 1:
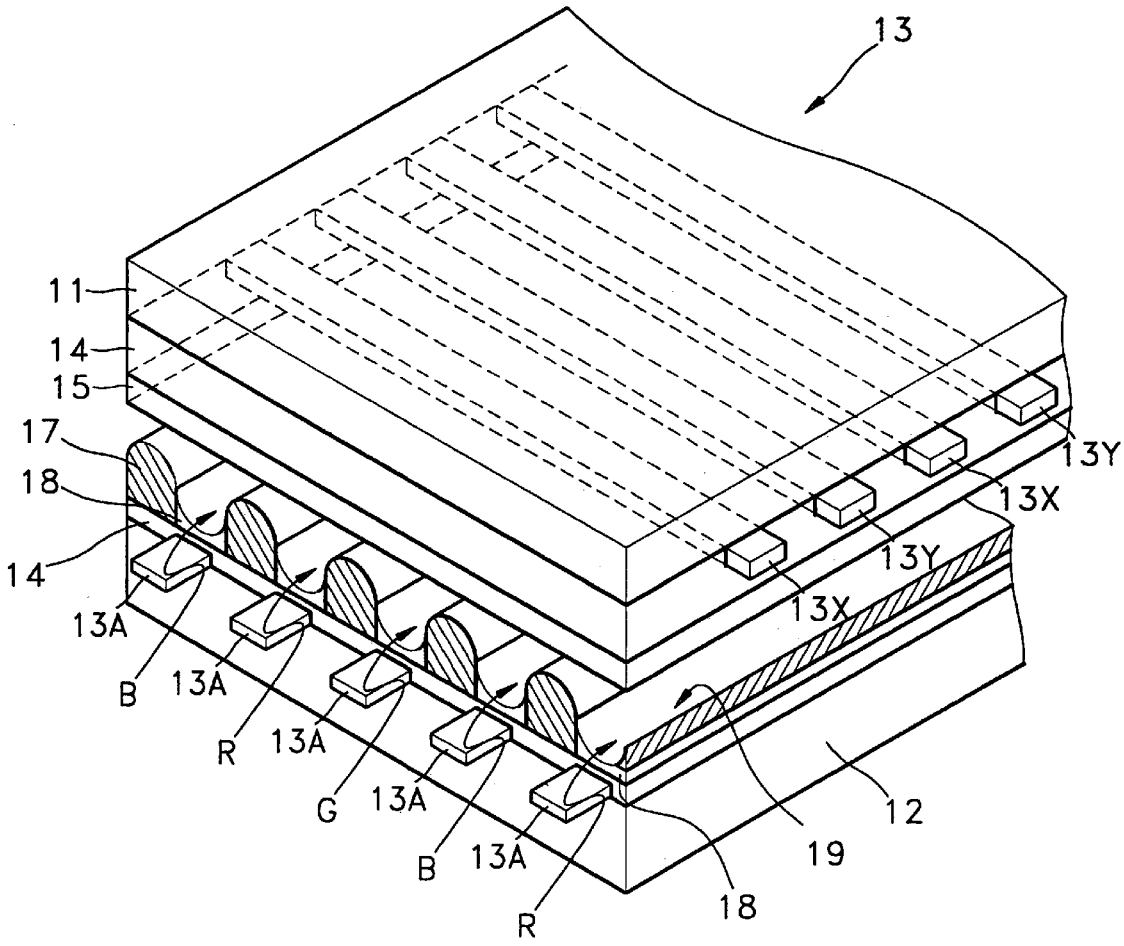
FIG. 1 PRIOR ART
FIG. 1 is an exploded perspective view showing the structure of a general plasma display device.
Figure 2:
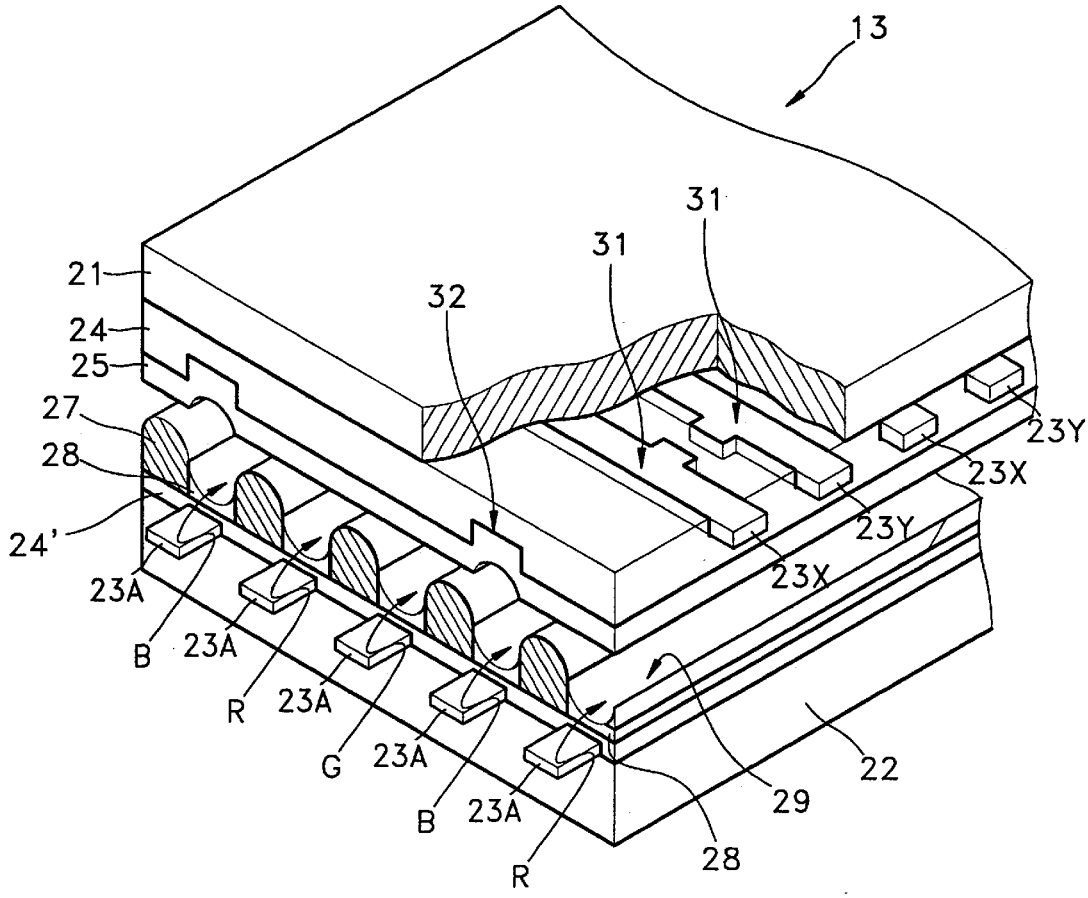
FIG. 2 is an exploded perspective view showing the structure of a plasma display device according to the first and second preferred embodiments of the present invention.

FIG. 2 shows a plasma display device according to the present invention, which is partially cut away. Referring to the drawing, the basic structure of the plasma display device is similar to that of the plasma display device shown in FIG. 1. Transparent first and second electrodes 23X and 23Y are formed in pairs on an inner surface of a front glass substrate 21. A third electrode 23A is on an inner surface of a rear glass substrate 22. When the two substrates 21 and 22 are assembled, the first electrode 23X and the second electrode 23Y cross the third electrode 23A perpendicularly. A dielectric layer 24 and a protective layer 25 are sequentially deposited on the inner surface of the front glass substrate 21. A plurality of partitions 27 are formed on the upper surface of a dielectric layer 24' forming a cell 29 between neighboring partitions 27. The cell 29 is filled with an inert gas such as argon (Ar). Also, a predetermined area of the side surface of the cell 29 is coated with a phosphor 28. Each of the cells 29 corresponds to a pixel producing one of red (R), green (G), or blue (B), and is coated with a phosphors corresponding to each color. A bus electrode (not shown) can be added to enhance the function of the first electrode 23*a* in another example.

According to the first preferred embodiment of the present invention, the dielectric layer 24 opposite a cell corresponding to a blue pixel is thinner than the dielectric layer 24 opposite cells corresponding to the red and green pixels. In FIG. 2, reference numeral 32 denotes a region where the thickness of the dielectric layer 24 decreases. The region 32 extends along the lengthwise direction of a cell corresponding to a blue pixel. As the efficiency in discharge increases at the region 32 together with the amount of ultraviolet light emitted, light emission by a blue phosphor is promoted so that the brightness thereof can be improved.

Figure 3:
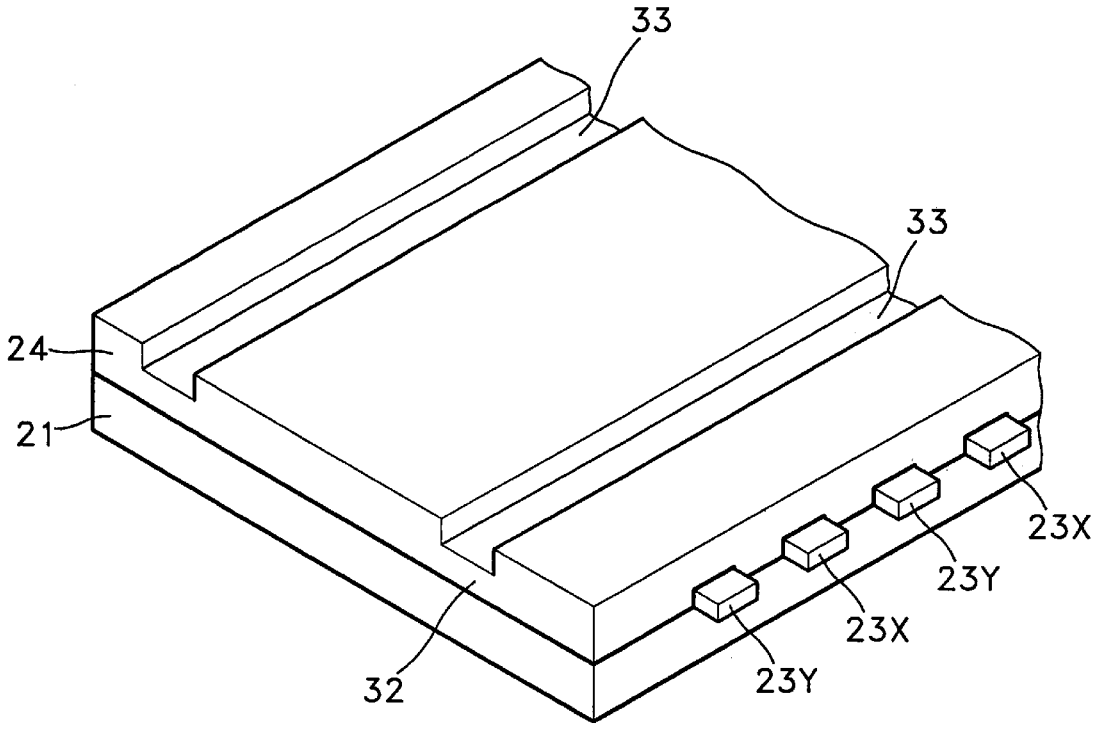
FIG. 3 is a perspective view showing the state in which the front glass substrate shown in FIG. 2 is reversed.

FIG. 3 shows the state in which the front glass substrate 21 shown in FIG. 2 is reversed and the protective layer 25 is removed. As shown in the drawing, a groove 33 is formed in the dielectric layer 24 lengthwise to the cell for the blue pixel. Thus, the thickness of the dielectric layer 24 corresponding to the cell for the blue pixel can be reduced.

According to the second preferred embodiment of the present invention, the first electrode 23X and the second electrode 23Y are close to each other at the position opposite the cell corresponding to the blue cell. That is, at the position opposite the cell for the blue pixel, the distance between first electrode 23X and the second electrode 23Y is smaller than that between the corresponding electrodes positioned opposite a cell corresponding to the red or green pixel. Reference numeral 31 of FIG. 2 denotes portions of the first and second electrodes 23X and 23Y corresponding to the position opposite the cell for the blue pixel which are close to each other.

Figure 4:
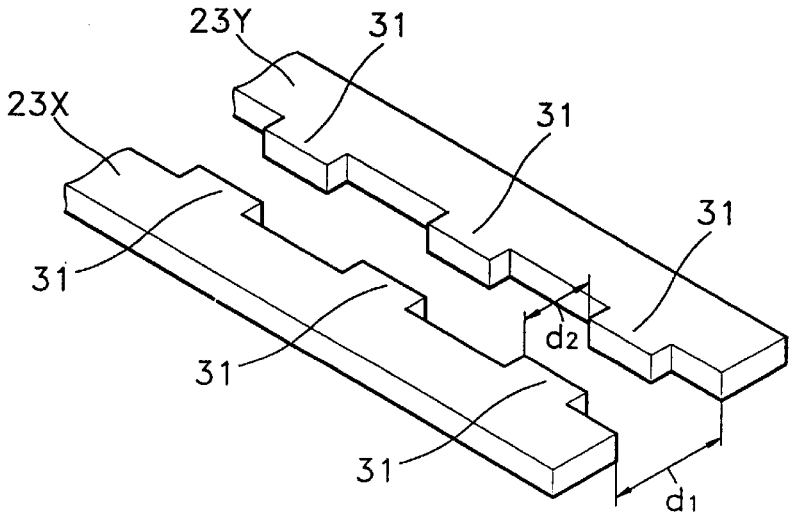
FIG. 4 is a perspective view showing the electrodes shown in FIG. 2.

FIG. 4 shows the electrodes shown in FIG. 2. As shown in the drawing, the distance $d_2$ between the electrodes 23X and 23Y opposite the cell for the blue pixel is smaller than that of the distance $d_1$ between the electrodes 23X and 23Y, opposite the cells for the red or green pixels. As the distance between the first electrode 23X and the second electrode 23Y opposite the cell for the blue pixel decreases, the efficiency of discharge therebetween increases and the amount of discharge light emitted increases. As a result, the efficiency of light emission from the blue pixel is improved.

According to the third preferred embodiment of the present invention, the widths of the first electrode 23X and the second electrode 23Y opposite the cell corresponding to the blue pixel are increased toward a region where the emission of light does not occur. That is, the width of the first electrode 23X and the second electrode 23Y at the position opposite the cell corresponding to the blue pixel are greater than those of the electrodes 23X and 23Y at the position opposite the cell corresponding to red and green pixels.

Figure 5:
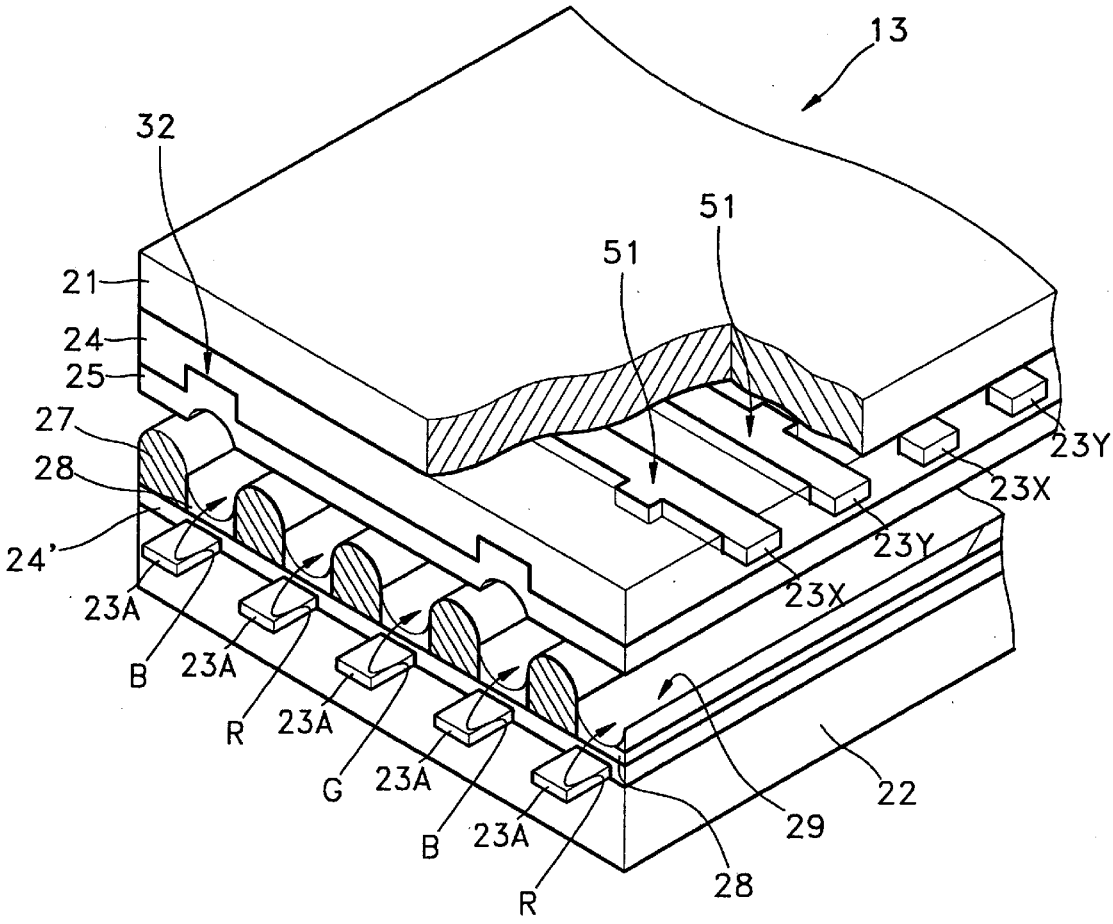
FIG. 5 is an exploded perspective view showing the structure of a plasma display device according to the third preferred embodiment of the present invention.

FIG. 5 shows the structure of a plasma display device according to the third preferred embodiment of the present invention. Reference numeral 51 in FIG. 5 shows that the widths of the first electrode 23X and the second electrode 23Y at the portions corresponding to the blue pixel are increased toward a region where the emission of light does not occur.

Figure 6:
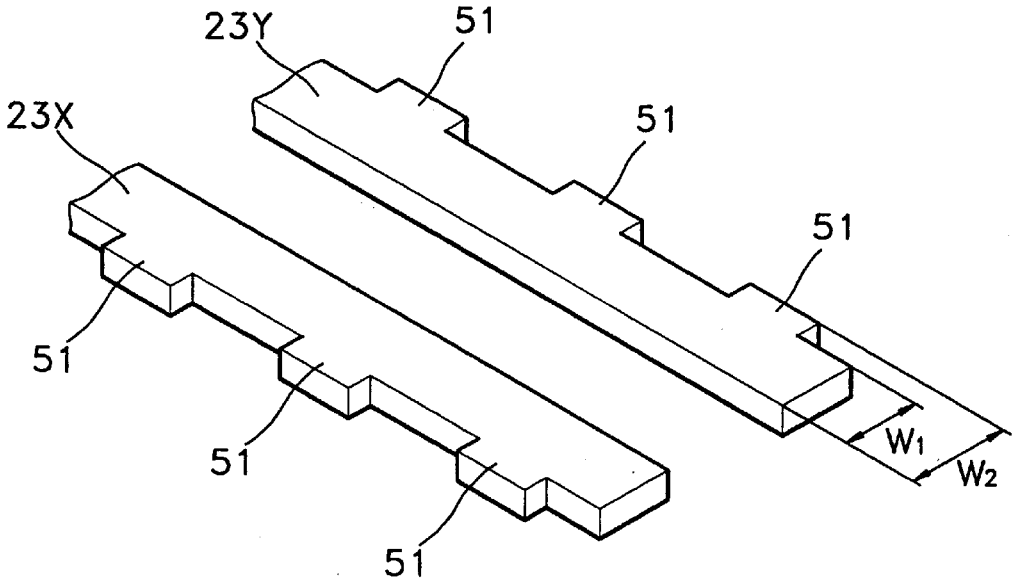
FIG. 6 is a perspective view showing the electrodes shown in FIG. 5.

FIG. 6 shows the electrodes shown in FIG. 5. As shown in the drawing, the portions 51 where the width of the electrode increases is formed to extend toward the region where light is not emitted so that the width $W_2$ of the first and second electrodes 23X and 23Y opposite the cell for the blue pixel is larger than the width $W_1$. of other portions. The formation of the portion 51 results in an increase in the area of the electrode, thus increasing the efficiency in discharge therebetween. Thus, as the amount of discharge light generated due to the discharge increases, the efficiency of light emission by the blue pixel is improved.

The above-described preferred embodiments of the present invention can be selectively adopted in a plasma display device. That is, only one of the embodiments of decreasing the thickness of the dielectric layer, narrowing the distance between the electrodes, and increasing the widths of the electrodes may be adopted. Of course, all three embodiments can be adopted together. In any event, the efficiency of light emission by the blue pixel increases to improve the brightness of the blue pixel.

As described opposite, in the plasma display device according to the present invention, as the brightness of the blue pixel is improved, the overall brightness of the device is improved and concurrently white balance can be easily represented. Also, the brightness can be improved by altering the structure of the device, not through a circuitry method.

It is noted that the present invention is not limited to the preferred embodiment described opposite, and it is apparent that variations and modifications by those skilled in the art can be effected within the spirit and scope of the present invention defined in the appended claims.

What is claimed is:

1. A plasma display device comprising:

a front substrate;

first and second electrodes parallel to each other and located on an inner surface of the front substrate;

a first dielectric layer on the inner surface of the front substrate covering the first electrode;

a rear substrate facing the front substrate;

a third electrode on an inner surface of the rear substrate crossing and perpendicular to the first and second electrodes;

a second dielectric layer on the inner surface of the rear substrate covering the third electrode;

partitions forming respective discharge spaces opposite the second dielectric layer on the rear substrate; and phosphors coating side surfaces of partitions of respective discharge spaces for respectively emitting one of red, green, and blue light, wherein the first or second electrode has a width at a position corresponding to a discharge space coated with the phosphor producing blue light, extending toward a region where light is not emitted, larger than widths of each of the first and second electrodes at positions corresponding to discharge spaces coated with the phosphors producing red and green light.

2. A plasma display device comprising:

a front substrate;

first and second electrodes parallel to each other and located on an inner surface of the front substrate;

a first dielectric layer on the inner surface of the front substrate covering the first electrode;

a rear substrate facing the front substrate;

a third electrode on an inner surface of the rear substrate crossing and perpendicular to the first and second electrodes;

a second dielectric layer on the inner surface of the rear substrate covering the third electrode;

partitions forming respective discharge spaces opposite the second dielectric layer on the rear substrate; and phosphors coating side surfaces of partitions of respective discharge spaces for respectively emitting one of red, green, and blue light, wherein distance between the first electrode and the second electrode at the discharge space coated with the phosphor producing blue light is smaller than distances between the first electrode and the second electrode at discharge spaces coated with the phosphors producing red and green light.

3. A plasma display device comprising:

a front substrate;

first and second electrodes parallel to each other and located on an inner surface of the front substrate;

a first dielectric layer on the inner surface of the front substrate covering the first electrode;

a rear substrate facing the front substrate;

a third electrode on an inner surface of the rear substrate crossing and perpendicular to the first and second electrodes;

a second dielectric layer on the inner surface of the rear substrate covering the third electrode;

partitions forming respective discharge spaces opposite the second dielectric layer on the rear substrate; and phosphors coating side surfaces of partitions of respective discharge spaces for respectively emitting one of red, green, and blue light, wherein the first dielectric layer at the discharge space coated with the phosphor producing blue light is thinner than the first dielectric layer at the discharge spaces coated with the phosphors producing red and green light.

4. The plasma display device of claim 1, wherein the first dielectric layer at the discharge space coated with the phosphor producing blue light is thinner than the first dielectric layer at the discharge spaces coated with the phosphors producing red and green light.

5. The plasma display device of claim 2, wherein the first dielectric layer at the discharge space coated with the phosphor producing blue light is thinner than the first dielectric layer at the discharge spaces coated with the phosphors producing red and green light.

* * * * *